US010065124B2

(12) United States Patent
Goslin et al.

(10) Patent No.: US 10,065,124 B2
(45) Date of Patent: Sep. 4, 2018

(54) INTERACTING WITH A REMOTE PARTICIPANT THROUGH CONTROL OF THE VOICE OF A TOY DEVICE

(71) Applicant: Disney Enterprises, Inc., Burbank, CA (US)

(72) Inventors: Michael P. Goslin, Sherman Oaks, CA (US); Blade A. Olson, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 249 days.

(21) Appl. No.: 14/996,461

(22) Filed: Jan. 15, 2016

(65) Prior Publication Data

US 2017/0203221 A1 Jul. 20, 2017

(51) Int. Cl.
*A63H 5/00* (2006.01)
*G10L 21/013* (2013.01)

(52) U.S. Cl.
CPC ..... *A63H 5/00* (2013.01); *G10L 21/013* (2013.01); *A63H 2200/00* (2013.01); *G10L 2021/0135* (2013.01)

(58) Field of Classification Search
USPC ..... 446/397
See application file for complete search history.

(56) References Cited

U.S. PATENT DOCUMENTS

| | | | | |
|---|---|---|---|---|
| 6,773,344 | B1 * | 8/2004 | Gabai | A63H 3/28 463/1 |
| 2003/0124954 | A1 * | 7/2003 | Liu | A63H 3/28 446/484 |
| 2009/0018826 | A1 * | 1/2009 | Berlin | G10L 15/07 704/223 |
| 2009/0043583 | A1 * | 2/2009 | Agapi | G10L 13/033 704/260 |
| 2013/0065482 | A1 * | 3/2013 | Trickett | A63H 11/00 446/397 |
| 2014/0058729 | A1 * | 2/2014 | Nagatomo | G10L 15/30 704/235 |

* cited by examiner

*Primary Examiner* — Pierre E Elisca
(74) *Attorney, Agent, or Firm* — Patterson + Sheridan, LLP

(57) ABSTRACT

Systems, methods and articles of manufacture to perform an operation comprising receiving speech data via a network, modifying the speech data based on a profile associated with a toy device, wherein the modified speech data represents a voice of the toy device, and outputting the modified speech data via a speaker.

20 Claims, 6 Drawing Sheets

INTERACTING WITH A REMOTE PARTICIPANT THROUGH CONTROL OF THE VOICE OF A TOY DEVICE

BACKGROUND

Field of the Disclosure

Embodiments disclosed herein generally relate to interacting with remote participants by controlling the voice of a toy device.

Description of the Related Art

Conventionally, toy devices have not been used facilitate interaction between a user local to the toy device and remote users. Instead, the user conventionally interacts with the toy in isolation, and remote users cannot interact with the user or the toy. It would be enjoyable for local and remote users to be able to interact while the toy is being used.

SUMMARY

In one embodiment, a method comprises receiving speech data via a network, modifying the speech data based on a profile associated with a toy device, wherein the modified speech data represents a voice of the toy device, and outputting the modified speech data via a speaker.

In another embodiment, a computer program product comprises a computer readable storage medium storing instructions which when executed by a processor performs an operation comprising receiving speech data via a network, modifying the speech data based on a profile associated with a toy device, wherein the modified speech data represents a voice of the toy device, and outputting the modified speech data via a speaker.

In another embodiment, a system comprises one or more processors and a memory containing a program which when executed by a processor performs an operation comprising receiving speech data via a network, modifying the speech data based on a profile associated with a toy device, wherein the modified speech data represents a voice of the toy device, and outputting the modified speech data via a speaker.

In another embodiment, a method comprises receiving speech data via a network, modifying the speech data based on a profile associated with a toy device, wherein the modified speech data represents a voice of the toy device, and outputting the modified speech data via a speaker.

BRIEF DESCRIPTION OF THE DRAWINGS

So that the manner in which the above recited aspects are attained and can be understood in detail, a more particular description of embodiments of the disclosure, briefly summarized above, may be had by reference to the appended drawings.

It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments disclosed herein provide techniques to allow remote users to speak on behalf of a toy device, thereby creating the appearance that the toy device is "talking back" to a user playing with the toy device. For example, a child may be playing with a toy device. The toy device may be a figurine that resembles an animal, such as a squirrel. A parent may log into an application on a remote computing device. When the parent speaks into the remote computing device, embodiments disclosed herein modify the parent's speech based on a speech profile that is specific to the toy device. For example, the speech profile may include a predefined pitch and pacing which may be applied to the speech data of the parent's speech. The modified speech may be outputted by a speaker that can be heard by the child. The output modified speech may be complemented with additional sounds to create a desired effect. For example, in the case of a squirrel toy, chattering or squeaking sounds may be output. As another example, sounds of a squirrel's habitat may be output to produce a desired ambience. In another embodiment, the toy device may be equipped with various actuators that allow parts of the toy device to be moved. For example, the squirrel toy may tap its foot, or move its head, or its mouth. The toy may also be provisioned with various effects that can be enabled in a manner conveying to the child who is speaking. For example, when the mother of the child is speaking through the toy, the toy may be illuminated with a particular color, say, pink. Whereas, when the sister of the child is speaking through the toy, the toy may be illuminated with another color—blue, for example. In addition, when the child replies, the parent can hear the child's voice, which is recorded via a microphone. The speaker and/or microphone may be a component of the toy device, a hub device associated with the toy device, or a separate speaker and/or microphone device communicably coupled to the toy device and/or the hub device (e.g., wireless headphones that include a microphone).

Figure 1:
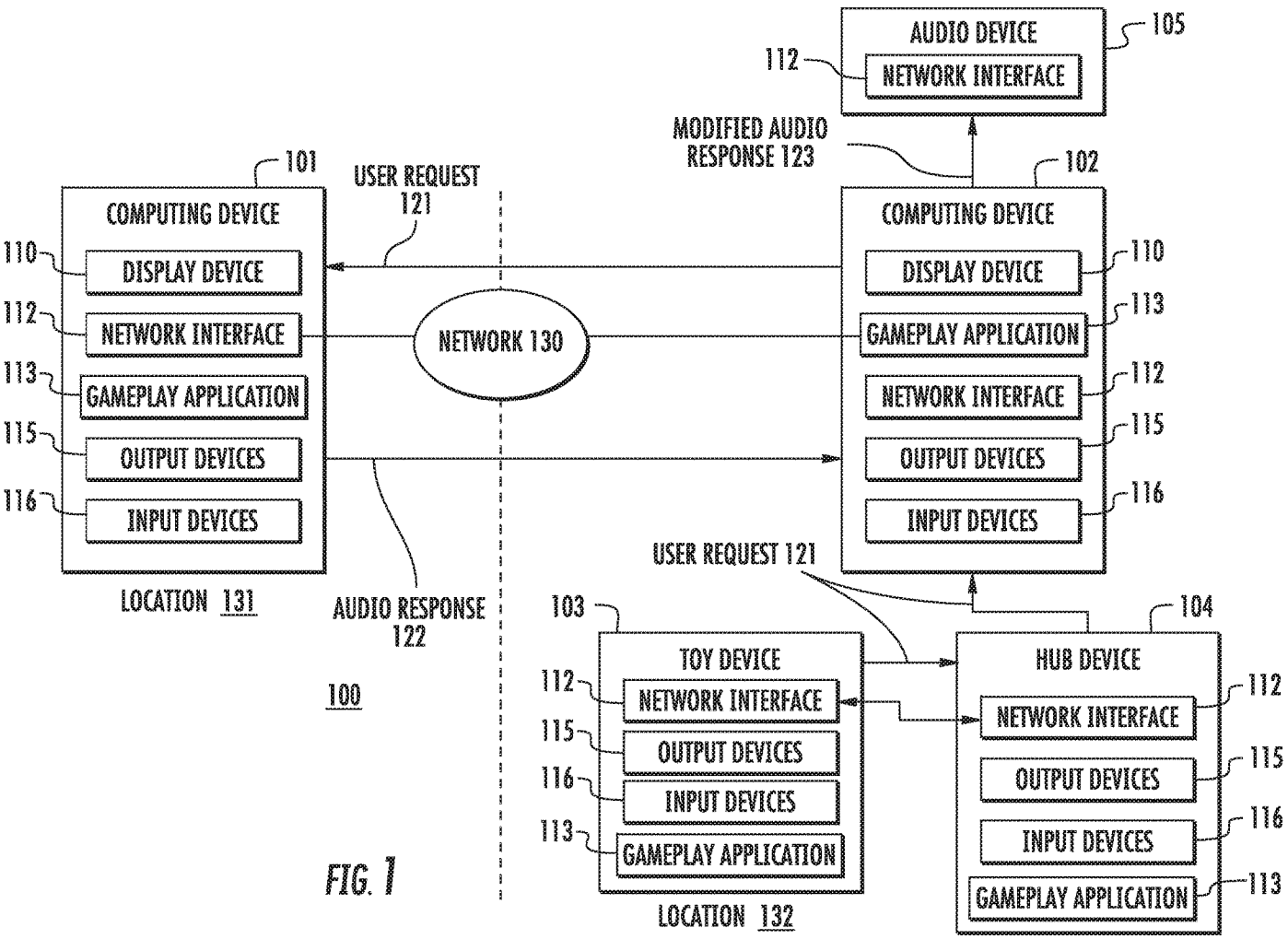
FIG. 1 is a block diagram illustrating components of a system configured to provide interaction with a remote participant through control of the voice of a toy device, according to one embodiment.

FIG. 1 is a block diagram illustrating components of a system 100 configured to provide interaction with a remote participant through control of the voice of a toy device, according to one embodiment. As shown, the system 100 includes computing devices 101, 102, a toy device 103, a hub device 104, and an audio device 105. As shown, the computing device 101 is in a location 131, different from a location 132 where the computing device 102, toy device 103, hub device 104, and audio device 105 are located. The locations 131, 132 are communicably coupled via a network 130. The locations 131, 132 may be different locations in the same building, such as rooms of a house, office, or school, or may be locations separated by greater distances. Examples of the computing devices 101, 102 include smartphones, laptops, tablets, desktop computers, video game consoles, wearable computing devices, toy devices, and the like.

As shown, the computing devices 101, 102 include a display device 110, a network interface 112, a gameplay application 113, output devices 115, and input devices 116. The display devices 110 include touchscreen displays or any other display device. The network interface 112 includes wired and wireless communication devices, such as 802.11 wireless, Bluetooth® modules (including Bluetooth® low energy (BTLE)), and the like. The output devices 115 include speakers, haptic feedback devices, and the like. The input devices 116 include microphones, keyboards, mice, and the like. The gameplay application 113 is a gaming platform configured to allow a user of the computing device 101 to control the voice of the toy device 103. The gaming application 113 of the computing devices 101, 102 is further configured to orchestrate gameplay on the toy device 103 and/or hub device 104. Generally, when a user of the toy device 103 speaks to the toy device 103, or otherwise generates an indication to communicate with a user of the computing device 101, the gameplay application 113 may output a notification to the user of the computing device 101 prompting that user to speak on behalf of the toy device. The gameplay application 113 of the computing device 101 may record the user's speech, and modify the resultant speech data to match a speech profile of a character associated with the toy device 103. In one embodiment, the gameplay application 113 of the computing device 102 modifies the speech data. The gameplay application 113 of the computing device 102 may receive the speech data (modified or unmodified) and output the modified speech data as if toy device 103 is speaking. The gameplay application 113 may output the modified speech data via the audio device 105, and/or the output devices 115 of the computing device 102, the toy device 103, and the hub device 104.

As shown, the toy device 103 includes a network interface 112, the gameplay application 113, a set of output devices 115, and a set of input devices 116. The network interface 112 again includes wired and wireless communication devices, such as 802.11 wireless, Bluetooth® modules (including Bluetooth® low energy (BTLE)), and the like. The network interface 112 may communicably couple the toy device 103 with the hub device 104, computing device 102, and/or the audio device 105. The gameplay application 113 of the toy device 103 provides different user experiences to a user interacting with the toy device, such as missions, objectives, and any other type of interactive gameplay. The gameplay application 113 of the toy device 103 may communicate with the other instances of the gameplay application 113 on the computing devices 101, 102, and hub device 104. The output devices 115 include speakers, magnets that can move the toy device 103, haptic feedback devices, and motion devices. The input devices 116 of the toy device 103 include input buttons, microphones, cameras, sensors, and the like.

In at least one embodiment, the hub device 104 is a base station for the toy device 103. In such embodiments, the toy device 103 may dock on (or otherwise physically connect to) the hub device 104. The hub device 104 also includes a network interface 112, the gameplay application 113, output devices 115, and input devices 116. The gameplay application 113 of the hub device 104 provides different user experiences to a user interacting with the toy device 103 and/or hub device 104, such as missions, objectives, and any other type of interactive gameplay. The gameplay application 113 of the hub device 104 may communicate with the other instances of the gameplay application 113 on the computing devices 101, 102, and toy device 103. The output devices 115 include speakers, magnets, haptic feedback devices, and motion devices. The input devices 116 of the toy device 103 include input buttons, microphones, cameras, sensors, and the like.

The audio device 105 may be any wired or wireless audio capture and output device, and may include a network interface 112. In one embodiment, the audio device 105 is a wireless Bluetooth® headset with speakers and a microphone.

As shown, the toy device 103 may generate a user request 121 responsive to some user input. Examples of user input which may generate the user request 121 include spoken commands, shaking the toy device 103, or providing input stimuli via the input devices 116. Generally, however, the user request 121 may be initiated by any one of the hub device 104, computing device 102, and audio device 105. As shown, the user request 121 is forwarded to the hub device 104 and from the hub device to the computing device 102. The computing device 102 may then forward the user request 121 to the computing device 101 via the network 130. In one embodiment, the gameplay application 113 of the computing devices 101, 102 may modify the request to be based on a current context of the user's play with the toy device 103. For example, if the toy device 103 represents an animal, the gameplay application 113 may modify the request to reflect that the animal is hungry. Therefore, the gameplay application 113 may then output a notification via the computing device 101 indicating that the animal of the toy device 103 is hungry, and suggest that the user of the computing device 101 inform the user interacting with the toy device 103 of the same. Therefore, the user of the computing device 101 may speak into a microphone of the computing device 101, and state "please feed me, I am hungry!" The gameplay application 113 may transmit the recorded speech data as an audio response 122 via the network 130 to the computing device 102. The gameplay application 113 of the computing devices 101, 102, may modify the audio response based on a profile associated with the toy device 103. For example, if the toy device 103 looks like a chipmunk, the profile may specify to apply a fast pace and high pitch to the audio response 122. The gameplay application 113 may also modify the audio response to include environmental sounds or animal sounds associated with the toy device 103. Therefore, the gameplay application 113 may include sounds associated with a chipmunk, such as chattering, as part of the modified audio response 123. Similarly, if the toy device 103 looks like an elephant, the profile may specify to apply a slow pace and low pitch to the audio response 122. Therefore, as shown, when the modified audio response 123 is sent to the audio device 105, the user listening via the audio device 105 hears speech as if it was generated by the toy device 103. As previously indicated, however, the modified audio response 123 may be output by any of the output devices 115 (e.g., speakers) of the toy device 103, hub device 104, and/or computing device 102. In addition, the users may continue to converse via the network 130, where speech spoken by the user of the computing device 101 is modified based on the profile of the toy device 103.

In addition, although not pictured, the remote device 101 may also be associated with a toy device 103 and a hub device 104. In such embodiments the speech spoken by the users in locations 131, 132 may be modified based on the respective profiles of the toy device 103 used in the remote location. Furthermore, although not pictured, the toy device 103 and/or the hub device 104 may include a camera. In such embodiments, the toy device 103 and/or the hub device 104 may transmit image or video data of a user to the computing device 101, which may output images or video of the user of the toy device 103 to the remote user of the computing device 101 during game play. Therefore, in addition to controlling the voice of the toy device 103, the remote user may also be able to view images and video of the user of the toy device 103.

Figure 2A:
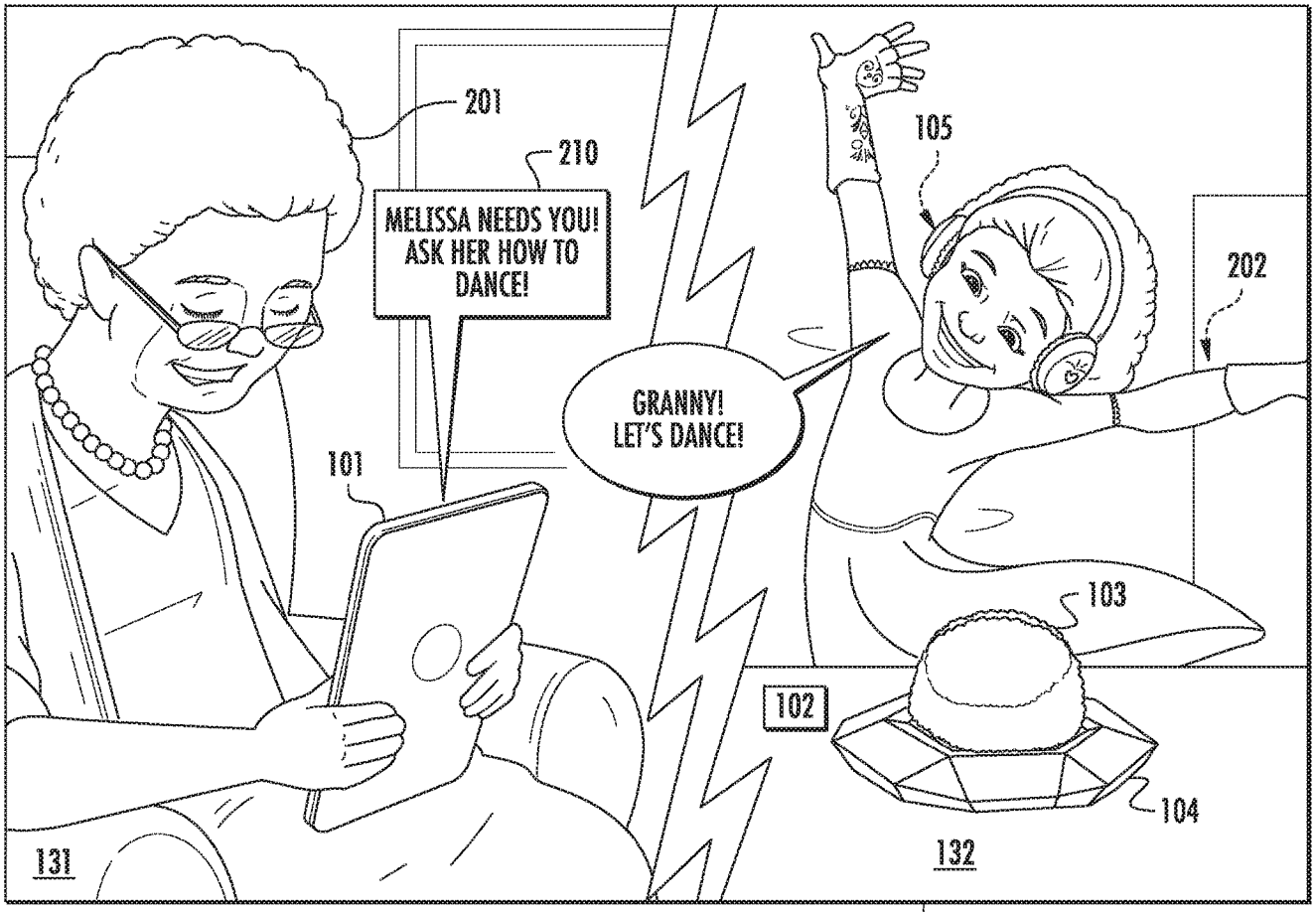
FIGS. 2A-2B illustrate techniques to provide interaction with a remote participant through control of the voice of a toy device, according to one embodiment.

FIG. 2A illustrates techniques to provide interaction with a remote participant through control of the voice of a toy device, according to one embodiment. As shown, FIG. 2A depicts a user 201 in location 131 and a user 202 in location 132. The user 201 is interacting with a tablet computing device 101, while the user 202 is interacting with a toy device 103 which is coupled to a hub device 104. In addition, the user 202 has access to a computing device 102 and wears the audio device 105. As shown, the user 202 may speak a request that is recorded by a microphone 116 of the computing device 102, toy device 103, hub device 104, and/or audio device 105. Specifically, the user 202 speaks "Granny! Let's Dance!" The speech may be transmitted via the network 130 to the computing device 101, where the gameplay application 113 may generate the notification 210, which prompts the user 201 to speak on behalf of the toy device 103. The gameplay application 113 may generate the notification 210 based on any number of factors, including analysis of the speech of the user 201, the current context of gameplay in the gameplay application 113, and the like. The notification 210 may be an audio based notification, a visual notification, or both.

Figure 2B:
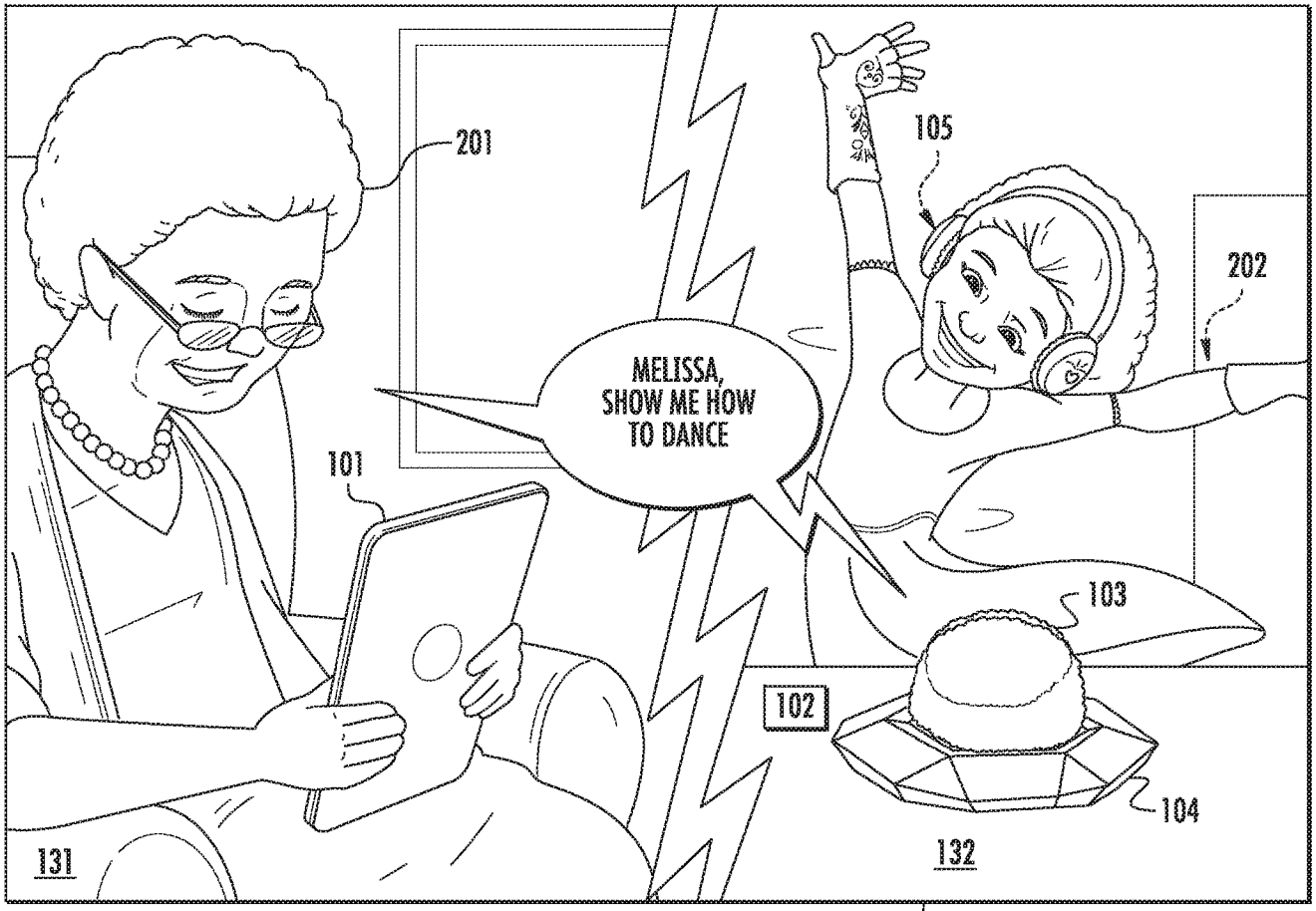

FIG. 2B depicts where the user 201 has spoken to the user 202 via the toy device 103. Specifically, as shown, the user 201 speaks "Mellissa, show me how to dance!" The computing device 101 may capture speech data representing the words spoken by the user 201. The gameplay application 113 on the computing device 101 may transmit the speech data to the gameplay application 113 on the computing device 102. One instance of the gameplay application 113 on the computing devices 101, 102 may further modify the speech data based on a profile associated with the toy device 103. The modified speech data may then be outputted to the user 202, creating the appearance that the toy device 103 is talking. The modified speech data may be outputted via the audio device 104, the output device 115 of the toy device 115, and/or the output device 115 of the hub device 115. The users 201, 202, may then continue to converse, where the speech of the user 201 is modified to sound as if it is the voice of the toy device 103.

For example, the toy device 103 may be a "pet" of the user 202, such as a dog, cat, or any other creature. The user 201 may then roleplay as the pet of the user 202 using the techniques described herein. In at least one embodiment, the pet toy device 103 may be paired with the user 201 via a user account of the gameplay application 113 and a gameplay application 113 account of the user 202. When roleplaying as a pet, the voice of the pet player may have their voice pitch shifted up to disguise their original identity and resemble the voice of the pet they are roleplaying as. In at least one embodiment, multiple toy devices 103 may participate in the same physical space, such as when different toy devices 103 are placed on the base 104. Once placed, any talking done by the user 201 may cause haptic feedback in a palm device (not pictured) worn by the user 202 to initiate. Similarly, the toy device 103 may move in response to the speech, making it seem as if the remote player is talking in the form of the their pet via haptics and other types of movement. Further still, the toy device 103 may output haptic feedback, or emit light in coordination with the speech of the remote user 201. For example, if the user 202 is holding the toy device 103 in her hand, the toy device 103 may output haptic feedback, light up, or move when the user 201 speaks on behalf of the toy device 103. Furthermore, the haptic feedback, movement, and light emission may be replicated on other toy devices that can communicate with the toy device 103 (e.g., via a local or remote network).

In at least one embodiment, to roleplay as a pet, one player may be required to use a computing device that is online and running the gameplay application 113, and another player may be required to use a toy device 103 that is paired with an account of the gameplay application 113. If these two player accounts are already paired, the player that is the "registered master" of the pet toy device 103 can speak through the voice of the pet as if they are that character. In at least one embodiment, only the "registered master" can speak through that specific pet toy device 103 so that there is no confusion between which player is which character when multiple user accounts are linked together. At the request of either the player, a connection request can be made. If a connection is requested and accepted, either on the toy device or on the mobile device, the phone player (or other remote computing device player) will be connected to the toy player and can participate in gameplay.

In roleplaying as a pet, the role-player (e.g, the user 201) may receive audio and textual updates on their computing device 101, 102 about what the current toy device 103 is experiencing and how the role-player can participate with the user interacting with the toy device 103 (e.g., the user 202). Role-players have voice streaming capability to the toy device 103 to help the player interacting with the toy device 103. The role-player may also hear quest-relevant audio to follow-along with the main player's adventure in the gameplay application 113.

For example, the role-playing user may hear an audio cue that lets the user know that wolves are attacking the toy device 103. The role-playing user may suggest that the player picks up a toy device 103 that looks like a bear and roar like a bear together to scare the wolves off. In at least one embodiment, the gameplay application 113 may output a suggestion to the role-playing user 201 to pick up the bear and roar like the bear. The toy device 103 and/or the hub device 104 may determine that the player has lifted up the bear toy device 103 and roared and the gameplay application 113 may then progress.

If the user 201 does not have the gameplay application 113 actively open on the computing device 101, the gameplay application 113 may output a popup notification on the computing device 101 to notify the user 201 that the user 202 is currently playing the gameplay application 113 using the toy device 103. The user 201 may then open the gameplay application 113, and begin participating in the gameplay application 113 with the user 202. The user 201 may be presented with a set of predefined options, such as "roar together to scare the wolves," "run away together," and "use magic together to keep the wolves away." The gameplay application 113 on the computing device and/or the hub device 104 may then output pre-recorded audio to the user 202 corresponding to the option selected by the user 201.

In at least one embodiment, the gameplay application 113 may coordinate multi-player interaction between the users 201, 202. Gameplay in the gameplay application 113 may be augmented by notifying the user 201 of the current state of game play, and selecting one or more predefined options on the computing device 101 to adapt the gameplay with the toy device 103 as the gameplay progresses. During these gameplay and role-playing scenarios, the voice of the user 201 may be modified to appear as if it is the voice of the toy device 103.

Figure 3:
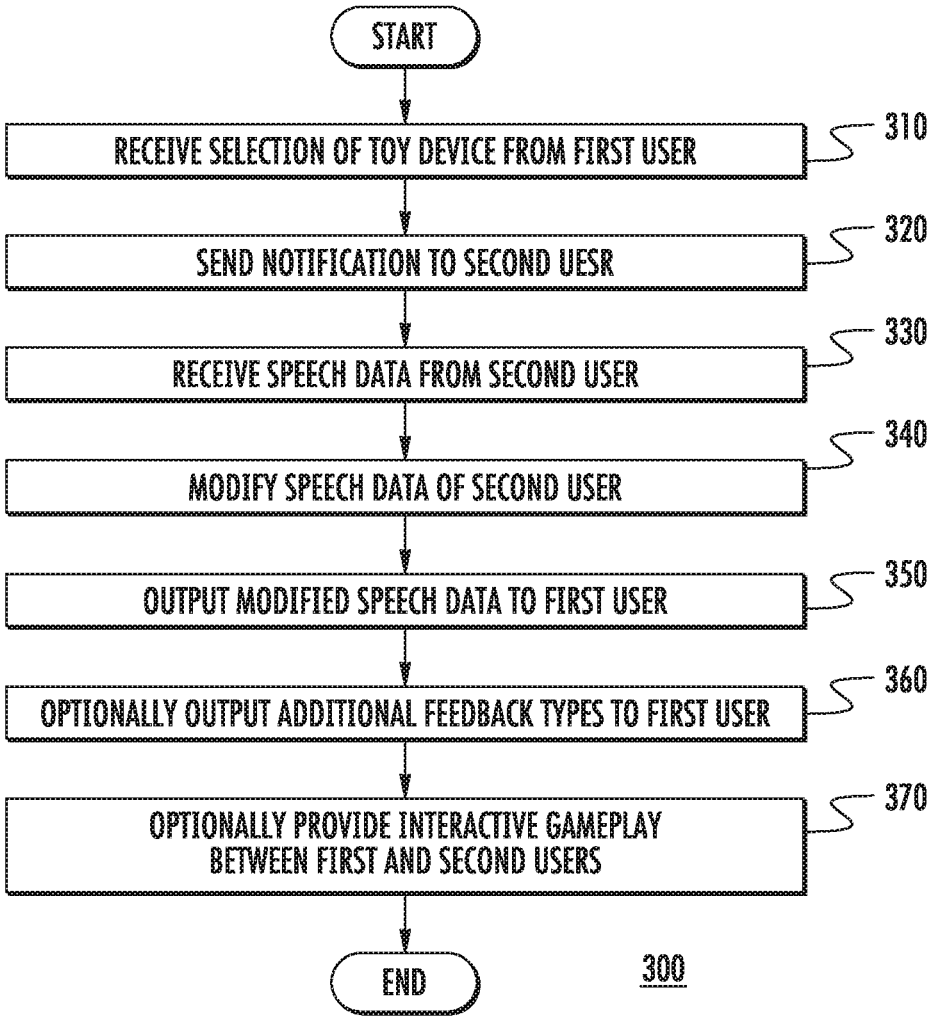
FIG. 3 is a flow chart illustrating a method to provide interaction with a remote participant through control of the voice of a toy device, according to one embodiment.

FIG. 3 is a flow chart illustrating a method 300 to provide interaction with a remote participant through control of the voice of a toy device, according to one embodiment. As shown, the method 300 begins at step 310, where a toy device 103 is selected by a first user. The user may have a plurality of toy devices, each with a respective device profile. The device profile may specify attributes of a "voice" of the respective toy device, such that the gameplay application 113 may modify the voice of a remote user to sound as if it is the voice of the toy device. At step 320, one or more of the toy device 103, the hub device 104, and/or the computing device 102 may send a notification to a second user in a remote location. The notification may include state information of the experience of the first user's interaction with the selected toy device 103, such as "the user's toy device is thirsty." The notification may further include suggested statements that the second user may speak to assist the first user in their interaction with the toy device 103. At step 330, the gameplay application 113 may receive speech data from the second user. At step 340, described in greater detail with reference to FIG. 4, the gameplay application 113 may modify the speech data of the second user. As previously indicated, the modified speech data may include additional sounds associated with the toy device, such as mooing of a cow, water splashing sounds for a swimming fish, and the like. At step 350, the gameplay application 113 may output the modified speech data to the first user, such that it appears as if the toy device is speaking to the first user. However, the remote user is actually controlling the voice of the toy device 103, and any words spoken by the remote user are adapted to match the voice of the toy device. At step 360, the gameplay application 113, the toy device 103, and/or the hub device 104 may output additional feedback responsive to the speech of the second user. For example, the toy device 103 may move or generate haptic feedback. In one embodiment, the gameplay application 113, the toy device 103, and/or the hub device 104 may perform speech-to-text analysis of the speech of the second user, and instruct the toy device 103 based on a determined meaning of the speech. For example, a recognized command such as "spin around" may result in the toy device 103 being instructed to spin responsive to the command. At step 370, the gameplay application 113 may optionally provide interactive gameplay between the first and second users.

Figure 4:
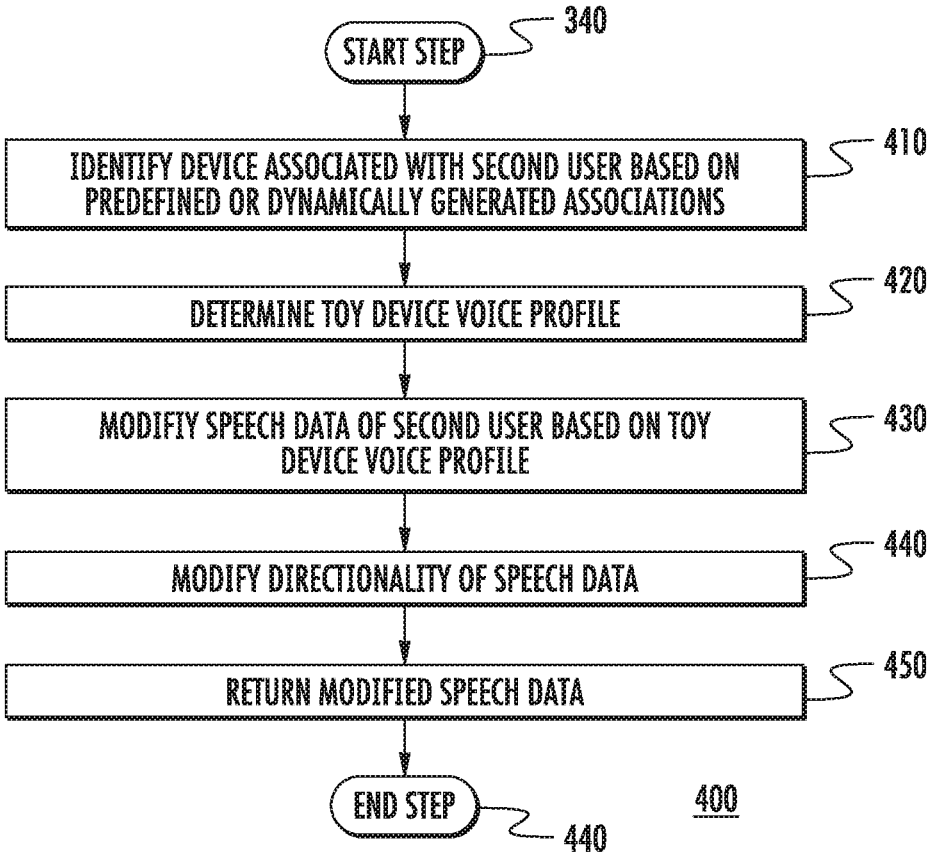
FIG. 4 is a flow chart illustrating a method to modify speech data, according to one embodiment.

FIG. 4 is a flow chart illustrating a method 400 corresponding to step 340 to modify speech data, according to one embodiment. As shown, the method 400 begins at step 410, where the gameplay application 113 identifies a toy device 103 associated with the second user. The association between the toy device 103 and the second user may be based on a predefined association or a dynamically generated association. At step 420, the gameplay application 113 may determine a voice profile associated with the toy device associated with the second user. At step 430, the gameplay application 113 may modify the speech data representing the speech of the second user based on the voice profile of the toy device 103. For example, the gameplay application 113 may modify the pacing and pitch of the speech data. However, any attribute of the user's speech may be modified based on the voice profile. At step 440, the gameplay application 113 may modify the directionality of the speech data such that the modified speech data appears to come from the area where the toy device is located relative to the first user. At step 450, the gameplay application 113 may return the modified speech data.

Figure 5:
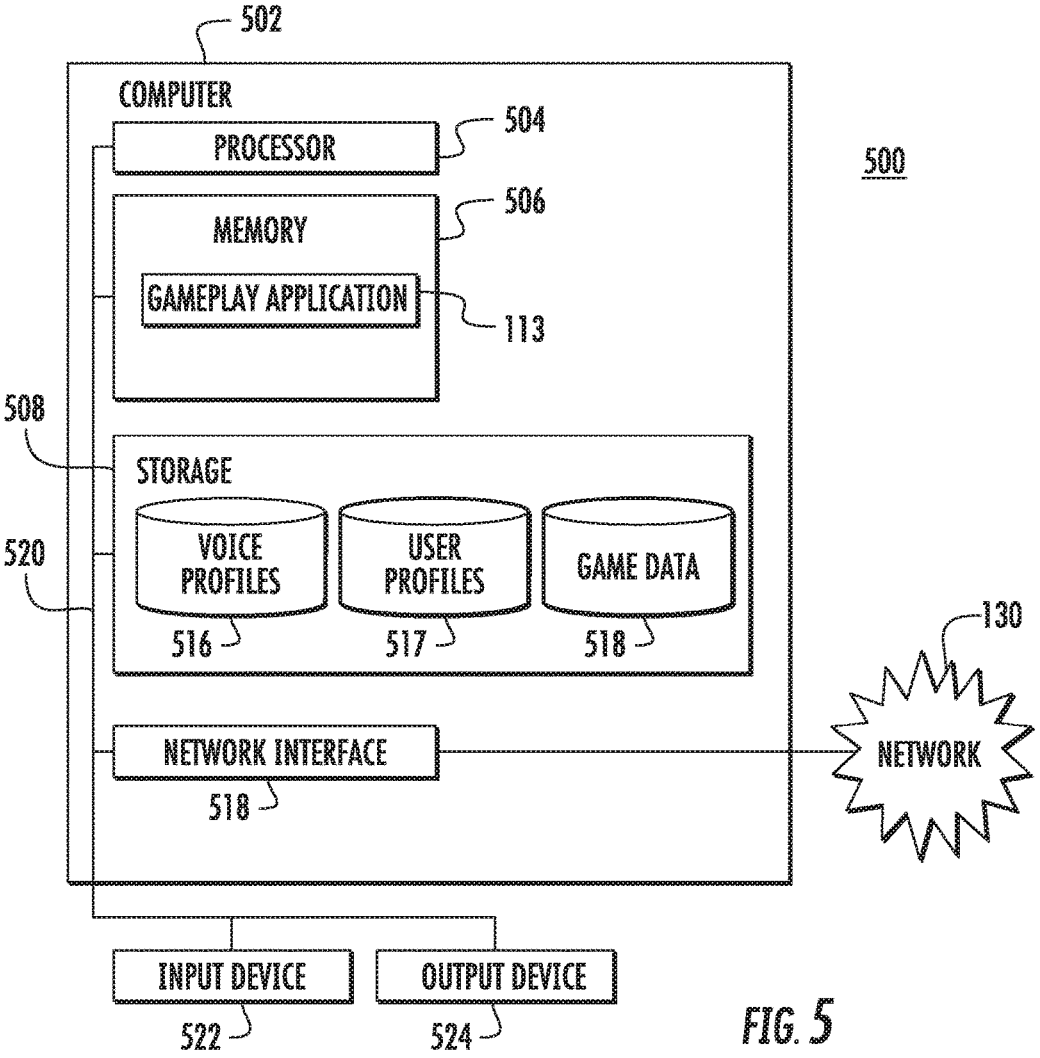
FIG. 5 is a block diagram illustrating a system configured to provide interaction with a remote participant through control of the voice of a toy device, according to one embodiment.

FIG. 5 is a block diagram illustrating a system 500 configured to provide interaction with a remote participant through control of the voice of a toy device, according to one embodiment. The networked system 500 includes a computer 502. The computer 501 may correspond to one or more of the computing devices 101, 102 of FIG. 1. The computer 502 may also be connected to other computers via a network 530. In general, the network 530 may be a telecommunications network and/or a wide area network (WAN). In a particular embodiment, the network 530 is the Internet.

The computer 502 generally includes a processor 504 which obtains instructions and data via a bus 520 from a memory 506 and/or a storage 508. The computer 502 may also include one or more network interface devices 518, input devices 522, and output devices 524 connected to the bus 520. The computer 502 is generally under the control of an operating system (not shown). Examples of operating systems include the UNIX operating system, versions of the Microsoft Windows operating system, and distributions of the Linux operating system. (UNIX is a registered trademark of The Open Group in the United States and other countries. Microsoft and Windows are trademarks of Microsoft Corporation in the United States, other countries, or both. Linux is a registered trademark of Linus Torvalds in the United States, other countries, or both.) More generally, any operating system supporting the functions disclosed herein may be used. The processor 504 is a programmable logic device that performs instruction, logic, and mathematical processing, and may be representative of one or more CPUs. The network interface device 518 may be any type of network communications device allowing the computer 502 to communicate with other computers via the network 530.

The storage 508 is representative of hard-disk drives, solid state drives, flash memory devices, optical media and the like. Generally, the storage 508 stores application programs and data for use by the computer 502. In addition, the memory 506 and the storage 508 may be considered to include memory physically located elsewhere; for example, on another computer coupled to the computer 502 via the bus 520.

The input device 522 may be any device for providing input to the computer 502. For example, a keyboard and/or a mouse may be used. The input device 522 represents a wide variety of input devices, including keyboards, mice, controllers, and so on. Furthermore, the input device 522 may include a set of buttons, switches or other physical device mechanisms for controlling the computer 502. The output device 524 may include output devices such as monitors, touch screen displays, and so on.

As shown, the memory 506 contains the gameplay application 113. As shown, the storage 508 contains the voice profiles 516, user profiles 517, and game data 518. The voice profiles 516 include attributes (such as pitch, pacing, gender, and the like) of a "voice" of each of a plurality of toy devices. The gameplay application 113 may use the attributes in the voice profiles 516 to modify a speech data to create the impression that the toy device 103 is speaking. In at least one embodiment, the toy device 103 may include a voice profile 516 (or an indication thereof) associated with the toy device 103. The voice profile 516 may further include attributes associated with the toy device 103, such as related animal sounds, related environmental sounds, and the like. The user profiles 517 may include associations between users and other users, users and toy devices, and any other user attributes. The game data 518 may include code executable to present an interactive gameplay environment, predefined audio responses, and predefined prompts and/or notifications that can be used by the gameplay application 113 during gameplay.

Advantageously, embodiments disclosed herein provide techniques to allow a remote user to control the voice of a remote toy device. The remote user may speak into a computing device. The user's speech data may be modified based on a voice profile associated with the toy device, such that the user's speech is adjusted to sound more like one would expect the voice toy device to sound like. The modified speech may then be outputted as the voice of the toy device.

In the foregoing, reference is made to embodiments of the disclosure. However, it should be understood that the disclosure is not limited to specific described embodiments. Instead, any combination of the recited features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the recited aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Embodiments of the disclosure may be provided to end users through a cloud computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. In context of the present disclosure, a user may access applications or related data available in the cloud. For example, the gameplay application 113 could execute on a computing system in the cloud and provide interactive gameplay for users. In such a case, the gameplay application 113 could modify the speech of a user based on a toy profile and store the modified speech at a storage location in the cloud. Doing so allows a user to access this information from any computing system attached to a network connected to the cloud (e.g., the Internet).

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A method, comprising:

receiving speech data generated based on a speech of a remote user via a network;

modifying the speech data based on a profile associated with a toy device, wherein the modified speech data represents a voice of the toy device, wherein the remote user is associated with the toy device based on one of: (i) a predefined association between the remote user and the toy device, and (ii) a dynamically generated association between the remote user and the toy device; and outputting the modified speech data via a speaker.

2. The method of claim 1, wherein the speech is outputted to a local user interacting with the toy device.

3. The method of claim 2, further comprising prior to receiving the speech data:

generating, by the toy device, a request for the remote user to speak through the toy device; and sending, via an application executing on a computing device of the local user, the request via the network to an application executing on a computing device of the remote user, wherein the computing device of the remote user is configured to receive a speech of the remote user and generate the speech data based on the speech of the remote user.

4. The method of claim 3, wherein the application executing on the computing device of the remote user presents a plurality of candidate speech options to the remote user, wherein the remote user speaks at least one of the candidate speech options in response, wherein the speech of the remote user comprises the at least one of the candidate speech options.

5. The method of claim 2, wherein the toy device is of a plurality of toy devices.

6. The method of claim 1, wherein modifying the speech data comprises:

determining, based on the profile, a pitch and a pacing of the voice of the toy device; and modifying the speech data the pitch and the pacing of the voice of the toy device.

7. The method of claim 1, wherein the toy device is communicably coupled with a hub device, wherein the speaker comprises one or more of: (i) a speaker disposed in the hub device, (ii) a speaker device communicably coupled to the hub device, the method further comprising:

while outputting the modified speech data, generating at least one of: (i) movement, (ii) haptic feedback, and (iii) light feedback in at least one of: (i) the toy device, and (ii) a second toy device on a network with the toy device.

8. A non-transitory computer-readable storage medium comprising computer-readable program code embodied therewith, the computer-readable program code executable by one or more computer processors to perform an operation comprising:

receiving speech data generated based on a speech of a remote user via a network;

modifying the speech data based on a profile associated with a toy device, wherein the modified speech data represents a voice of the toy device, wherein the remote user is associated with the toy device based on one of: (i) a predefined association between the remote user and the toy device, and (ii) a dynamically generated association between the remote user and the toy device; and outputting the modified speech data via a speaker.

9. The computer program product of claim 8, wherein the speech is outputted to a local user interacting with the toy device.

10. The computer program product of claim 9, the operation further comprising prior to receiving the speech data:

generating, by the toy device, a request for the remote user to speak through the toy device; and sending, via an application executing on a computing device of the local user, the request via the network to an application executing on a computing device of the remote user, wherein the computing device of the remote user is configured to receive a speech of the remote user and generate the speech data based on the speech of the remote user.

11. The computer program product of claim 10, wherein the application executing on the computing device of the remote user presents a plurality of candidate speech options to the remote user, wherein the remote user speaks at least one of the candidate speech options in response, wherein the speech of the remote user comprises the at least one of the candidate speech options.

12. The computer program product of claim 9, wherein the toy device is of a plurality of toy devices.

13. The computer program product of claim 8, wherein modifying the speech data comprises:

determining, based on the profile, a pitch and a pacing of the voice of the toy device; and modifying the speech data the pitch and the pacing of the voice of the toy device.

14. The computer program product of claim 8, wherein the toy device is communicably coupled with a hub device, wherein the speaker comprises one or more of: (i) a speaker disposed in the hub device, (ii) a speaker device communicably coupled to the hub device, the operation further comprising:

while outputting the modified speech data, generating at least one of: (i) movement, (ii) haptic feedback, and (iii) light feedback in at least one of: (i) the toy device, and (ii) a second toy device on a network with the toy device.

15. A system, comprising:

one or more computer processors; and a memory containing a program which when executed by the processors performs an operation comprising:

receiving speech data generated based on a speech of a remote user via a network;

modifying the speech data based on a profile associated with a toy device, wherein the modified speech data represents a voice of the toy device;

outputting the modified speech data via a speaker; and while outputting the modified speech data, generating at least one of: (i) movement, (ii) haptic feedback, and (iii) light feedback in the toy device.

16. The system of claim 15, wherein the speech is outputted to a local user interacting with the toy device.

17. The system of claim 16, the operation further comprising prior to receiving the speech data:

generating, by the toy device, a request for the remote user to speak through the toy device; and sending, via an application executing on a computing device of the local user, the request via the network to an application executing on a computing device of the remote user, wherein the computing device of the remote user is configured to receive a speech of the remote user and generate the speech data based on the speech of the remote user.

18. The system of claim 17, wherein the application executing on the computing device of the remote user presents a plurality of candidate speech options to the remote user, wherein the remote user speaks at least one of the candidate speech options in response, wherein the speech of the remote user comprises the at least one of the candidate speech options.

19. The system of claim 17, wherein the toy device is of a plurality of toy devices.

20. The system of claim 17, wherein the toy device is communicably coupled with a hub device, wherein the speaker comprises one or more of: (i) a speaker disposed in the hub device, (ii) a speaker device communicably coupled to the hub device, wherein modifying the speech data comprises:

determining, based on the profile, a pitch and a pacing of the voice of the toy device; and modifying the speech data the pitch and the pacing of the voice of the toy device.

* * * * *